US007061354B1

(12) United States Patent
Leupold

(10) Patent No.: US 7,061,354 B1
(45) Date of Patent: Jun. 13, 2006

(54) STRONG QUASI HORSESHOE MAGNET

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 11 days.

(21) Appl. No.: 11/086,726

(22) Filed: Mar. 15, 2005

(51) Int. Cl.
*H01F 7/20* (2006.01)

(52) U.S. Cl. ..... 335/285; 335/302; 335/306

(58) Field of Classification Search ..... 335/302–306, 335/285
See application file for complete search history.

(56) References Cited

U.S. PATENT DOCUMENTS 4,835,506 A 5/1989 Leupold
4,837,542 A 6/1989 Leupold
5,216,400 A 6/1993 Leupold
5,216,401 A 6/1993 Leupold
5,245,621 A 9/1993 Leupold
5,337,472 A 8/1994 Leupold
5,382,936 A 1/1995 Leupold et al.
5,428,334 A 6/1995 Leupold et al.
5,428,335 A 6/1995 Leupold et al.
5,438,308 A 8/1995 Leupold et al.
5,666,097 A * 9/1997 Leupold ..... 335/302
5,990,774 A * 11/1999 Leupold ..... 335/306

* cited by examiner

*Primary Examiner*—Ramon M. Barrera
(74) *Attorney, Agent, or Firm*—Michael Zelenka; Roger C. Phillips

(57) ABSTRACT

A permanent magnet assembly, for engaging a generally planar surface of a ferromagnetic object to affix items of interest thereto, includes a shell of a magnetic material. The shell has a portion of either a magic sphere or a magic cylinder and a cavity and the shell terminates in a surface that is generally planar for engaging a ferromagnetic object. The permanent magnet assembly also has an insert located in the cavity. A method of fabricating the permanent magnet assembly is also presented.

4 Claims, 2 Drawing Sheets

STRONG QUASI HORSESHOE MAGNET

GOVERNMENT INTEREST

The invention described herein may be manufactured, used, imported, sold, and licensed by or for the Government of the United States of America without the payment of any royalty thereon or there for.

BACKGROUND OF THE INVENTION

1. Field of the Invention

The present invention relates generally to simple, permanent magnets and, more particularly, to simple, permanent magnets having an increased magnetic force.

2. Related Art

There is considerable use for simple, permanent magnets of the horseshoe and bar magnet varieties. Common uses include simple paper anchors on refrigerators, field modifiers for more complex magnet systems, the retrieval of iron and other magnetic objects, location indicators for surgical implements, and machine shop anchors and dogs. Generally, these magnets are very limited in the strength of the magnetic field that they can generate.

Examples of permanent magnets having a relatively high field strength but that extends within an interior cavity of the magnet include permanent magnets configured in the form of a magic sphere or a magic cylinder. U.S. Pat. No. 5,216,401 describes each of these permanent magnet structures.

One way to further increase the field strength located within an interior cavity of a magic sphere or magic cylinder type of a permanent magnet, is to employ a magnetic insert. U.S. Pat. Nos. 5,382,936, 5,428,334 and 5,428,335, each of which are incorporated by reference herein, describe a permanent magnet assembly comprising a cylindrical or spherical shell of magnetic material having a hollow central cavity. The shell is permanently magnetized to produce a magnetic field within the central cavity and a magnetic insert is disposed in the central cavity to enhance the magnetic field therein.

SUMMARY OF THE INVENTION

In accordance with an embodiment of the present invention, a permanent magnet assembly, for engaging a generally planar surface of a ferromagnetic object to affix items of interest thereto, comprises a shell of a magnetic material. The shell comprises a portion of either a magic sphere or a magic cylinder and a cavity and the shell terminates in a surface that is generally planar for engaging a ferromagnetic object. The permanent magnet assembly also comprises an insert located in the cavity.

In accordance with another aspect of the present invention, a method of fabricating a permanent magnet assembly, for engaging a generally planar surface of a ferromagnetic object to affix items of interest thereto, comprises providing a shell of a magnetic material that comprises a portion of either a magic sphere or a magic cylinder and wherein the shell also comprises a cavity and terminates in a surface that is generally planar for engaging a ferromagnetic object; and locating an insert in the cavity.

BRIEF DESCRIPTION OF THE DRAWINGS

The following detailed description is made with reference to the accompanying drawings, in which.

DETAILED DESCRIPTION OF THE PREFERRED EMBODIMENT

The present invention concerns a permanent magnet assembly that has a significant increase in magnetic field strength over that of prior art horseshoe and bar magnets. In one embodiment, the permanent magnet assembly may comprise a modified magic sphere or magic cylinder which provides for a relatively large magnetic field that extends away from the magnet rather than internal to it. In this way, the permanent magnet assembly may function as a powerful lifting or securing magnet that is many times stronger than a prior art horseshoe or bar magnet while maintaining a relatively small structural mass and bulk.

Figure 3:
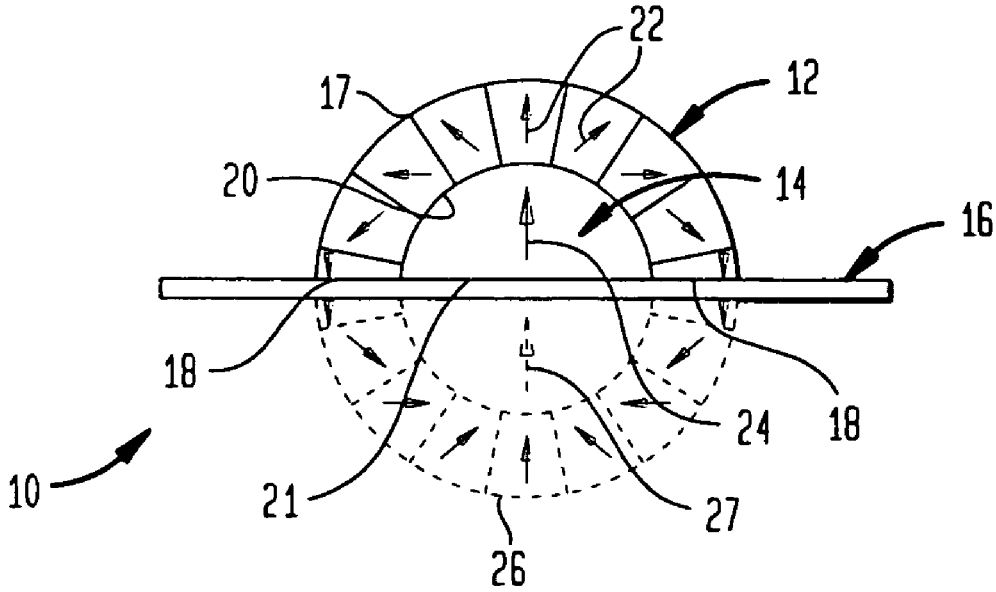
FIG. 3 is a diagrammatical, cross-sectional view of a permanent magnet assembly comprising a permanent magnet shell, an insert and a plate in accordance with an embodiment of the present invention.

Referring now to FIG. 3, a permanent magnet assembly in accordance with one embodiment of the present invention is illustrated generally at 10. In this embodiment, the permanent magnet assembly 10 comprises a shell 12 and an insert 14 which together may be attracted to an item of interest such as a plate 16. The shell 12 may be composed of a magnetic material such as a cobalt-rare earth or a rare earth-iron and may comprise an arcuate portion 17 (diagrammatically shown in cross section) of, e.g., a magic sphere or a magic cylinder as described in U.S. Pat. No. 5,216,401 and incorporated herein by reference. Briefly and in accordance with a magic sphere or cylinder, the shell 12 is composed of a magnetic material that is permanently magnetized in a direction such that the remanence varies continuously about a polar angle of the shell. The shell 12 is shown for illustrational purposes as that of a portion of a magic sphere, although, it will be appreciated that a magic ring or cylinder may instead be employed to form a horseshoe-like outer configuration.

The shell 12 may also comprise a generally flat portion 18 and a cavity 20. The insert 14 may be configured to fit within the cavity 20 and may also include a generally flat portion 21. The insert 14 may comprise a ferromagnetic material such as iron. The plate 16 is shown for illustrational purposes and may represent a portion of a refrigerator door or other such surface to which it is desired to releasably affix items (not shown), such as exemplary homework assignments or other items that would heretofore require a fastener.

The magnetization of the shell 12 is represented in direction by arrows 22 that may rotate in direction about the periphery of the shell and a uniform magnetic field represented by arrow 24 is disposed within the cavity 20.

Figure 1:
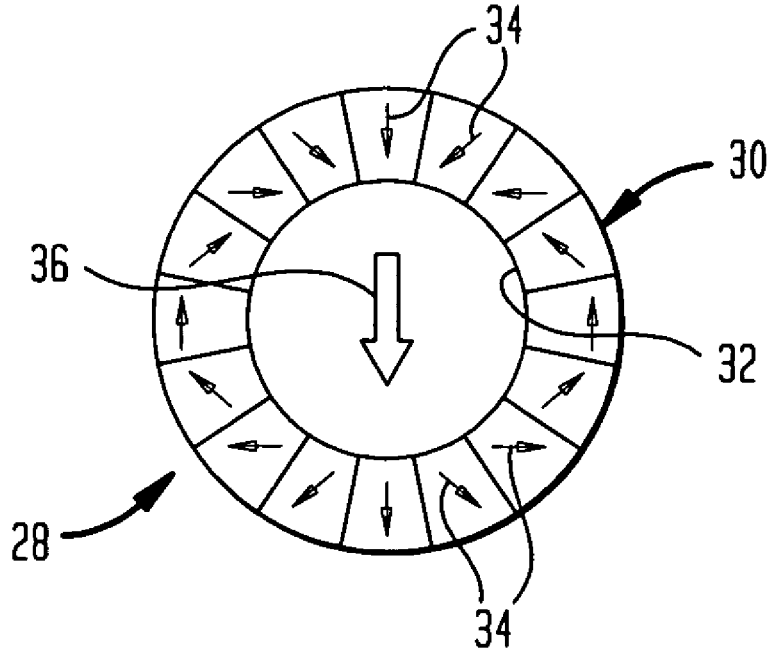
FIG. 1 (PRIOR ART)
FIG. 1 is a diagrammatical, cross-sectional view of a prior art magic sphere having a cavity through which a uniform magnetic field extends.
Figure 2:
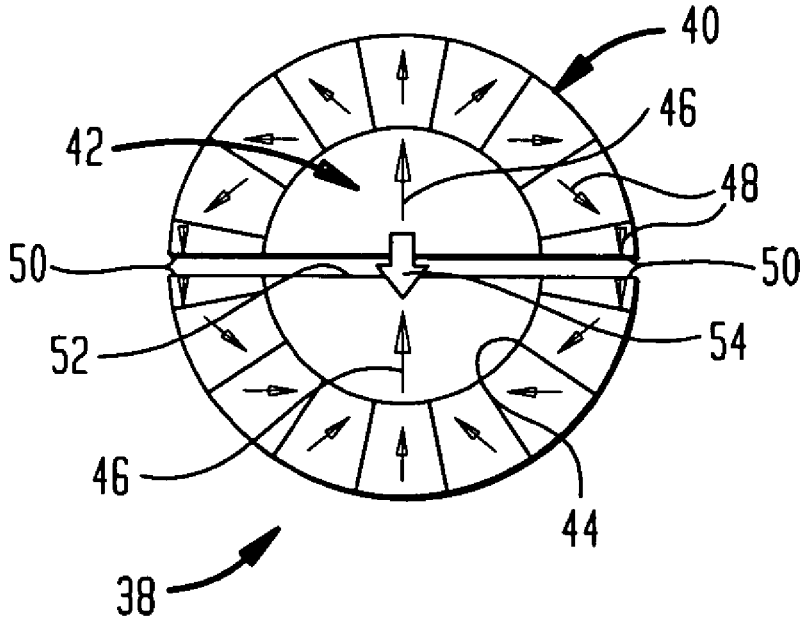
FIG. 2 (PRIOR ART)
FIG. 2 is a diagrammatical, cross-sectional view of a prior art magic sphere having a cavity and an access bore and an iron insert located within the cavity.

For a better understanding of the present invention and the magnetic field extending from and about the shell 12, it may be first useful to describe the magnetization of a magic sphere, as shown in FIG. 1, and thereafter describe the combination of a magic sphere and a magnetic insert as shown in FIG. 2. It will be appreciated that a magic cylinder, is similarly combinable with a magnetic insert to form a horseshoe-like magnet, although, for brevity this is not described in detail.

Referring to FIG. 1, a cross section of a magic sphere 28 having a shell 30 including a cavity 32 is shown. A magnetization of the shell 30 is represented by arrows 34 and disposed within the cavity 32 is a uniform field (H), represented by arrow 36, which may be found by equation (1).

$$H=4/3(B_r In(r_o/r_i)) \quad (1)$$

where:

$B_r$ is the magnetic remanence; and $r_o$ and $r_i$ are an inner and outer radii, respectively.

FIG. 2 illustrates a cross section of a magic sphere 38 that includes a shell 40 and an insert 42 that is disposed within a cavity 44. The shell 40 may comprise a magnetic material similar to that of the shell 12 and the insert 42 may comprise a ferromagnetic material such as iron. An arrow 46 represents the magnetization of the insert 42 and arrows 48 represent a magnetization of the shell 40. Access ports 50 communicate with a bore or a gap 52 that extends through the insert 42. Arrow 54 represents a uniform magnetic field extending through the gap 52. Further details of a magic sphere similar to that of magic sphere 38 may be found in U.S. Pat. Nos. 5,382,936, 5,428,334 and 5,428,335 previously incorporated herein by reference.

The total force (F) of attraction to a passive material (such as plate 16) may be found, under a known principle of virtual work, by taking a derivative of energy stored in the gap 42. Accordingly, the force (F) then may be represented by the energy density in the gap 42 multiplied by a cross-sectional area (A) of the gap as reflected in equation (2).

$$F=(B^2/8\pi)(A) \quad (2)$$

where:

B is a flux density (in Gaussian units);

$(B^2/8\pi)$ is an energy density; and

A is a cross-sectional area.

In view of the foregoing and referring again to FIG. 3, the force (F) of attraction for the insert 14, using, for example, an $r_o/r_i=2$, $r_i=1$ cm for the flat portions 18 and 21 and an average field (B) that may be approximately 25,000 Gauss and or 2.5 Teslas for the permanent magnet assembly 10, may be found by equation (3):

$$F_{(insert)}=(25000)^2/8\pi)(\pi)(1)^2 \quad (3)$$

$$F_{(insert)}=176 \text{ Pounds.}$$

Next, a force (F) of attraction exerted by the shell 12 may be found given that an area of the flat portion 18 may be found by $\pi(r_o^2-r_i^2)=\pi(2^2-1^2)=3\pi$. Thereafter the force (F) by the shell may be determined by equation (4).

$$F_{(shell)}=((25000)^2/8\pi)(3\pi) \quad (4)$$

$$F_{(shell)}=528 \text{ Pounds}$$

In sum, the total force (F) of attraction for the example permanent magnet assembly 10 is 528+176 or 704 pounds. It will be appreciated that the dimensions of the example permanent magnet may be reduced to provide for a suitable total force of attraction depending on the application.

Figure 4:
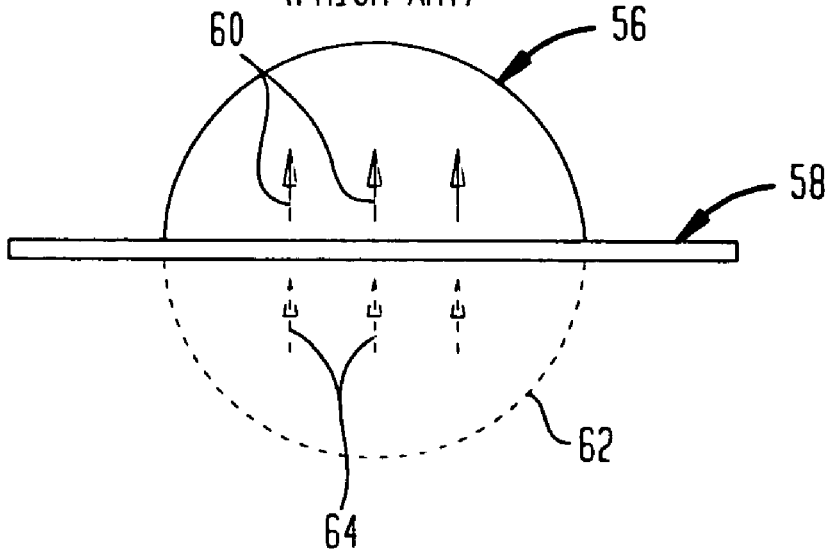
FIG. 4 (PRIOR ART)
FIG. 4 is a diagram showing a prior art, solid permanent magnet hemisphere that is mounted to a plate.

Referring now to FIG. 4, a solid, conventional, permanent magnet 56 comprising a hemispherical shape and being attracted to a plate 58 is shown. The permanent magnet 56 has a direction of magnetization represented by arrows 60 and produces an anti-image 62 and magnetic field in the direction of arrows 64. The permanent magnet 56 may comprise the same material as that of the shell 12, described above and r=2 cm.

The total force (F) of attraction for the example permanent magnet assembly 10 may compared to the force (F) of attraction of the solid conventional permanent magnet 56 that is of the same dimension and material magnetized (arrows 60) perpendicular to the base which found by equations (5) and (6).

$$B=B_r(2/3) \quad (5)$$

B=9.33 kiloGaus $$F=(9,333)^2/8\pi)(4\pi) \quad (6)$$

F=97.9 Pounds

Accordingly, the example permanent magnet assembly 10 is approximately 704/97.9 or 7.2 times as strong as the conventional permanent magnet 56.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A method of affixing non-ferromaqnetic items of interest to a generally planar surface of a ferromagnetic object using a permanent magnet assembly, the method comprising:

providing a non-ferromagnetic item of interest, a ferromagnetic object and a permanent magnet assembly comprising a single continuous shell of a magnetic material that has an outer configuration that consists of a generally hemispherical portion of a magic sphere or that consists of a generally horseshoe shaped portion of a magic cylinder and wherein the shell comprises a cavity and terminates in a surface that is generally planar for engaging the ferromagnetic object and the permanent magnet assembly further comprising an insert located in the cavity and wherein the shell and the insert combine to provide a force (F) of attraction that is greater than about 700 pounds found by the formula:

$$F=(B^2/8\pi)(A)$$

where:

B is a flux density (in Gaussian units);

$(B^2/8\pi)$ is an energy *density*; and

A is a cross-sectional area which equals approximately $3\pi$;

locating the item of interest between the permanent magnet assembly and the ferromagnetic object; and moving the permanent magnet assembly adjacent the item of interest and, in turn, the item of interest adjacent the ferromagnetic object.

2. The method of claim 1, wherein the insert comprises iron.

3. The method of claim 1, wherein the shell and the insert combine to provide at least seven times a force (F) of attraction of a solid, conventional, permanent magnet having the same dimension as that of the shell and the insert combined and wherein the solid, conventional, permanent magnet comprises the same material as that of the shell.

4. The method of claim 1, wherein the shell and insert each have an average field (B) of approximately 25,000 Gauss.

* * * * *